US007683862B2

(12) United States Patent
Lee

(10) Patent No.: US 7,683,862 B2
(45) Date of Patent: Mar. 23, 2010

(54) ACTIVE MATRIX ORGANIC LIGHT EMITTING DIODE DISPLAY CAPABLE OF DRIVING AND PRE-CHARGING PIXELS USING A CURRENT SOURCE AND DRIVING METHOD THEREOF

(75) Inventor: I-Shu Lee, Taoyuan (TW)

(73) Assignee: AU Optronics Corp., Hsin-Chu (TW)

( * ) Notice: Subject to any disclaimer, the term of this patent is extended or adjusted under 35 U.S.C. 154(b) by 684 days.

(21) Appl. No.: 11/428,577

(22) Filed: Jul. 5, 2006

(65) Prior Publication Data

US 2007/0164935 A1 Jul. 19, 2007

(30) Foreign Application Priority Data

Jan. 19, 2006 (TW) ..... 95102113 A

(51) Int. Cl.
*G09G 3/32* (2006.01)

(52) U.S. Cl. ..... 345/82

(58) Field of Classification Search ..... 345/76–82; 315/169.3

See application file for complete search history.

(56) References Cited

U.S. PATENT DOCUMENTS 6,972,745 B2 * 12/2005 Pfeiffer et al. ..... 345/89
7,167,150 B2 * 1/2007 Yang et al. ..... 345/89
7,515,148 B2 4/2009 Lee
2005/0225518 A1 * 10/2005 Yamada et al. ..... 345/77
2005/0264499 A1 * 12/2005 Kim et al. ..... 345/76
2006/0050043 A1 * 3/2006 Kawagoe ..... 345/98
2006/0158441 A1 7/2006 Lee

FOREIGN PATENT DOCUMENTS

CN 1409403 A 4/2003
CN 1464498 A 12/2003
CN 1632850 A 6/2005
CN 1632855 A 6/2005
CN 1705002 A 12/2005
TW 591578 6/2004

* cited by examiner

*Primary Examiner*—Sumati Lefkowitz
*Assistant Examiner*—Rodney Amadiz
(74) *Attorney, Agent, or Firm*—Winston Hsu

(57) ABSTRACT

A display includes a plurality of data lines, a plurality of scan lines, a plurality of pixel circuits, a source driver, a gate driver, a timing controller and a gray scale circuit. The source driver includes a data line driving circuit for generating driving current corresponding to an image to be displayed by a pixel circuit, a current source for pre-charging the pixel circuit and a switch for electrically connecting the current source to the pixel circuit or electrically isolating the current source from the pixel circuit. The timing controller controls the source driver and the gate driver. The gray scale circuit controls the switch of the source driver based on gray scales of images to be displayed by the pixel circuits of a scan line.

16 Claims, 6 Drawing Sheets

ACTIVE MATRIX ORGANIC LIGHT EMITTING DIODE DISPLAY CAPABLE OF DRIVING AND PRE-CHARGING PIXELS USING A CURRENT SOURCE AND DRIVING METHOD THEREOF

BACKGROUND OF THE INVENTION

1. Field of the Invention

The present invention relates to an active matrix organic light emitting display and driving method thereof, and more particularly, to an active matrix organic light emitting display having a pre-charge current source and driving method thereof.

2. Description of the Prior Art

Flat panel displays have advantages such as low power consumption, no radiation and thin appearance, and have therefore gradually replaced traditional cathode ray tube (CRT) displays. Various kinds of flat panel displays have been developed to offer consumers better products. Among them, organic light emitting diode (OLED) displays have gained more and more attention due to their characteristics such as self-emitting light source, high brightness, high contrast, high emission rate, fast reaction, wide viewing angle, and low power consumption.

An OLED is a current-driven device whose luminance is determined by the driving current passing through the OLED. By controlling the value of the driving current, images having different brightness (or different gray scales) can be displayed. OLED displays can be categorized into passive matrix organic light emitting diode (PMOLED) displays and active matrix organic light emitting diode (AMOLED) displays according to the driving methods. In a PMOLED display, pixels on different rows/columns (scan lines/data lines) are driven sequentially. The luminance of each pixel is thus limited by the scan frequency and the number of the scan lines. Therefore, the PMOLED displays are mainly used in small-sized and low-resolution displays. In an AMOLED display, each pixel has a separate pixel circuit comprising a storage capacitor, an OLED and two thin-film transistors (TFTs). The pixel circuits can control the amount of current supplied to corresponding OLEDs. Therefore, the AMOLED displays can achieve uniform display characteristics by supplying a stable driving current to each pixel, and are particularly suitable for applications in large-sized and high-resolution displays.

FIG. 1 shows a diagram of a prior art AMOLED panel 10. The AMOLED panel 10 includes a data line DL, a scan line GL, and a pixel circuit 100. The pixel circuit 100 includes an OLED 110, a storage capacitor 120, TFTs 130 and 140, and voltage sources Vcc and Vss. The TFT 130 includes a gate coupled to the scan line GL and a drain coupled to the date line DL. The TFT 140 includes a gate coupled to a source of the TFT 130 and a drain coupled to the voltage source Vcc. The storage capacitor 120 is coupled between the source of the TFT 130 and ground, and the OLED 110 is coupled between the source of the TFT 140 and the voltage source Vss. When displaying an image, a scan signal is sent to the TFT 130 via the scan line GL for turning on the TFT 130, thereby coupling the storage capacitor 120 to the data line via the TFT 130. Also, current from the data line charges the storage capacitor 120 and a gate voltage required for turning on the TFT 140 is stored in the storage capacitor 120. Once the TFT 140 is turned on, a current $I_{OLED}$ flows through the OLED 110, whose luminance is determined by the value of the current $I_{OLED}$. The current $I_{OLED}$ can be represented by the following formula:

$$I_{OLED}=\tfrac{1}{2}\mu\cdot C_{OX}\cdot W/L\cdot(V_{GS}-V_{TH})^2;\text{ where}$$

$\mu$ is the electron mobility;

$C_{OX}$ is the gate oxide capacitance per unit area of the TFT 140;

W is the channel width of the TFT 140;

L is the channel length of the TFT 140;

$V_{TH}$ is the threshold voltage of the TFT 140; and $V_{GS}$ is the voltage difference between the gate and the source of the TFT 140.

The gray scales of images displayed by the pixel circuit 110 is determined by the value of $I_{OLED}$, which is controlled by the voltage $V_{GS}$ based on charges stored in the storage capacitor 120. When displaying an image of a low gray scale, the pixel circuit 100 requires a small current $I_{OLED}$. To generate a corresponding small voltage $V_{GS}$, the current sent from the data line for charging the storage capacitor 120 is also small. Under this circumstance, the small current cannot efficiently charge the storage capacitor 120 for providing a sufficient voltage $V_{GS}$, and the pixel circuit 110 might not be able to completely display the image having the required low gray scale. Therefore, the prior art AMOLED displays have poor display quality when displaying images of low gray scales.

SUMMARY OF THE INVENTION

The present invention provides a method for driving an active matrix organic light emitting diode display comprising determining whether a gray scale of an image to be displayed by a pixel circuit on a scan line is smaller than a gray scale reference value, transmitting a pre-charging current to the pixel circuit if the gray scale of the image to be displayed by the pixel circuit is smaller than the gray scale reference value, and transmitting signals corresponding to the image to the pixel circuit after transmitting the pre-charging current to the pixel circuit.

The present invention also provides an active matrix organic light emitting diode display comprising a plurality of data lines for transmitting data signals, a plurality of scan lines for transmitting scan signals, a plurality of pixel circuits coupled to corresponding data lines and scan lines, a source driver comprising a data line driving circuit for generating a driving current corresponding to an image to be displayed by a pixel circuit, a current source for pre-charging a data line before sending the driving current to the data line, and a switch coupled between the current source and the data line for electrically connecting the current source to the data line, or for electrically isolating the current source from the data line, a gate driver coupled to the plurality of scan line for generating control signals, a timing controller for controlling the source driver and the gate driver based on video and timing data, and a gray scale circuit for controlling the switch of the source driver based on a gray scale of an image to be displayed by a pixel circuit of a scan line.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
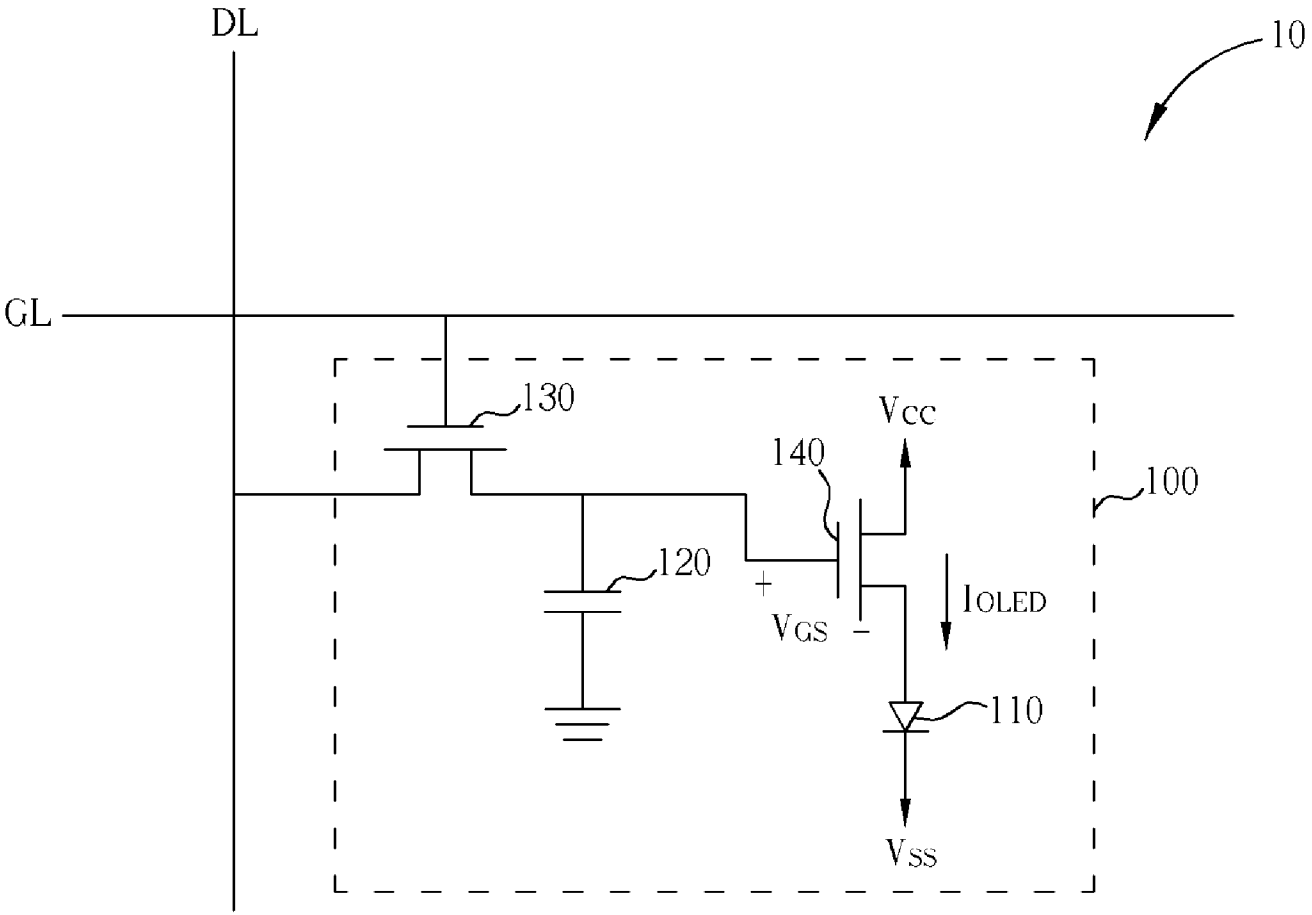
Fig. 1 Prior Art
FIG. 1 is a pixel circuit diagram of a prior art AMOLED panel.
Figure 2:
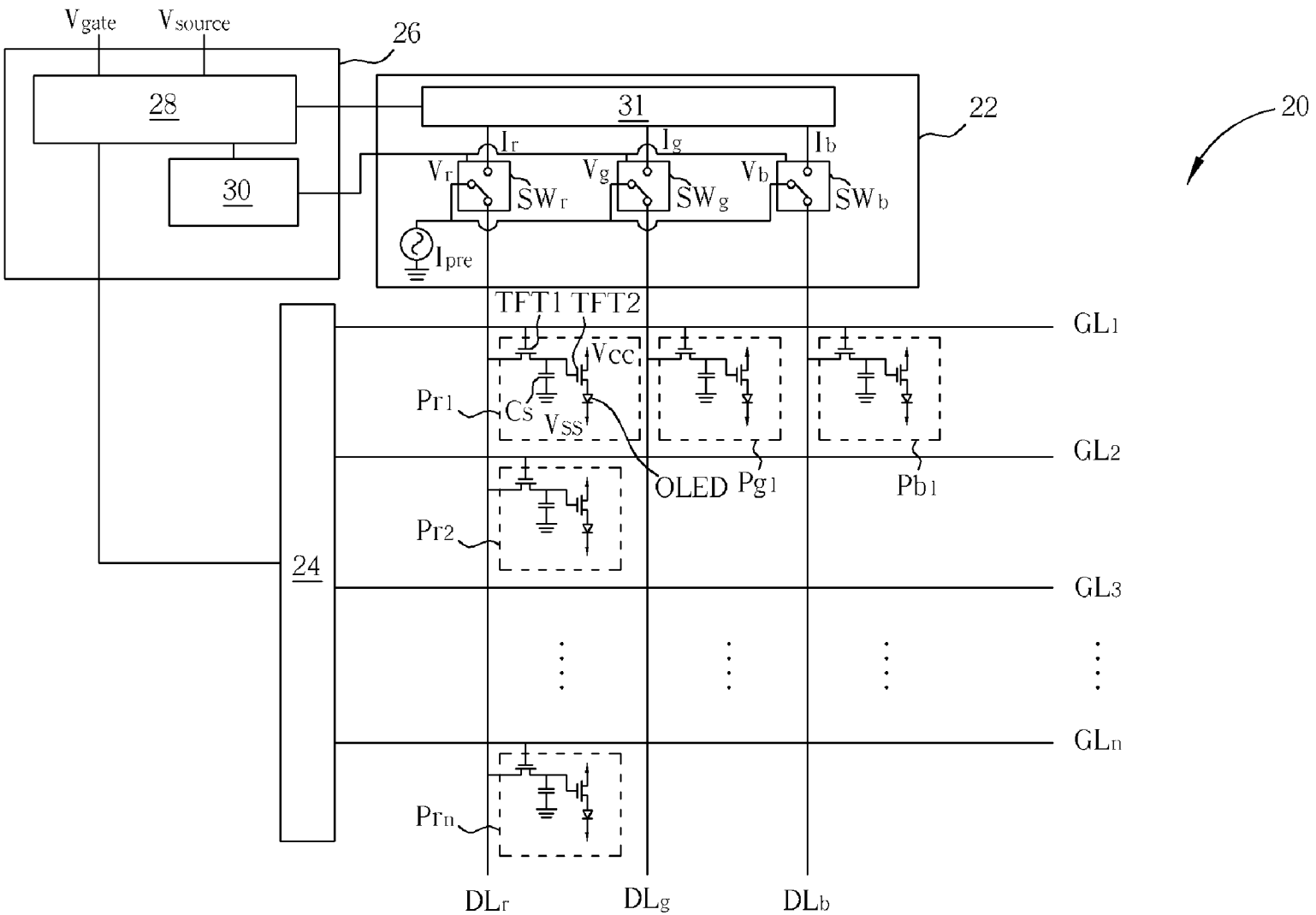
FIG. 2 is a diagram of an AMOLED panel according to the present invention.

FIG. 2 shows a diagram of an AMOLED panel 20 according to the present invention. The AMOLED panel 20 includes data lines $DL_r$, $DL_g$, $DL_b$, scan lines $GL_1$-$GL_n$, pixel circuits $Pr_1$-$Pr_n$, $Pg_1$-$Pg_n$, $Pb_1$-$Pb_n$, a source driver 22, a gate driver 24, and a control circuit 26. Each pixel circuit includes an organic light emitting diode (OLED), a storage capacitor Cs, thin film transistors TFT1 and TFT2, and voltage sources Vcc and Vss. The thin film transistor TFT1 of each pixel circuit includes a gate coupled to a corresponding scan line and a drain coupled to a corresponding date line DL. The thin film transistor TFT2 of each pixel circuit includes a gate coupled to a source of a corresponding thin film transistor TFT 1 and a drain coupled to the voltage source Vcc. The storage capacitor Cs of each pixel circuit is coupled between the source of a corresponding thin film transistor TFT1 and ground, and the organic light emitting diode OLED is coupled between the source of a corresponding thin film transistor TFT2 and the voltage source Vss.

The control circuit 26, coupled to the source driver 22 and the gate driver 24, includes a timing control circuit 28 and a gray scale circuit 30. Based on the timing signals $V_{gate}$ and the data signal $V_{source}$ of images to be displayed by the AMOLED panel 20 in a frame period, the timing control circuit 28 generates corresponding control signals to the source driver 22 and the gate driver 24. Based on the gray scales of images to be displayed by the AMOLED panel 20 in a frame period, the gray scale circuit 30 generates corresponding switch control signals $V_r$, $V_g$, and $V_b$. The operations of the timing control circuit 28 and the gray scale circuit 30 will be described in more detail.

Figure 3:
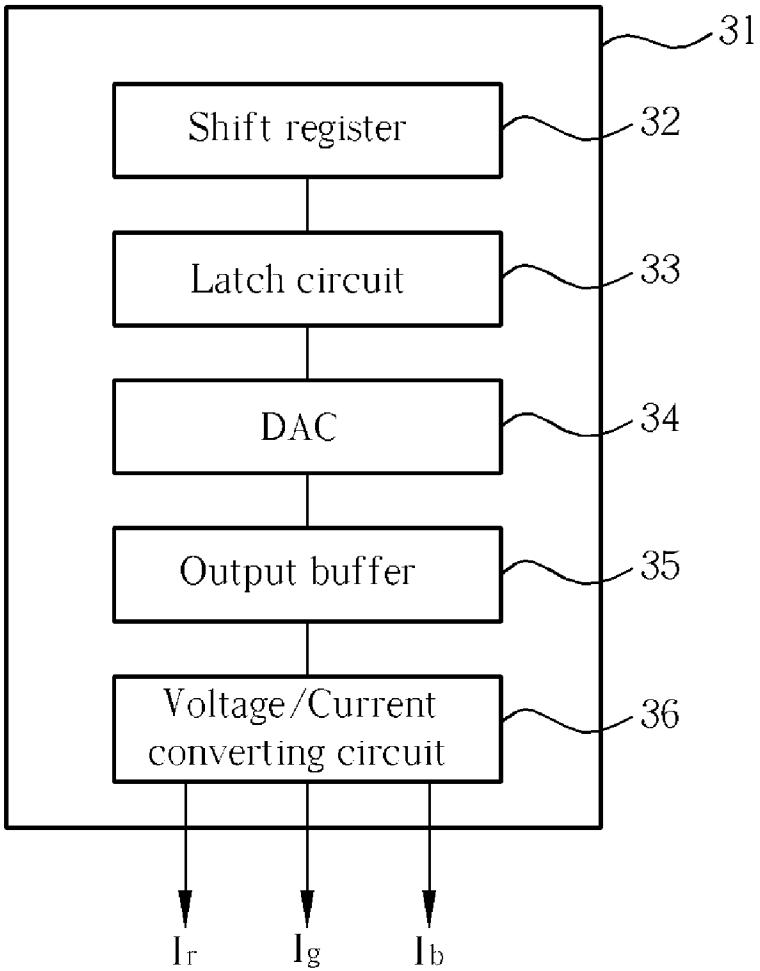
FIG. 3 shows an enlarged diagram of a data line driving circuit of the AMOLED panel in FIG. 2.

The source driver 22 includes a data line driving circuit 31, a pre-charge current source $I_{pre}$, and switches $SW_r$, $SW_g$, and $SW_b$. FIG. 3 shows an enlarged diagram of the data line driving circuit 31 according to the present invention. The data line driving circuit 31 includes a shift register 32, a latch circuit 33, a digital-to-analog converter (DAC) 34, an output buffer 35, and a voltage/current converting circuit 36. The shift register 32 temporally stores digital image data received from the timing control circuit 28 and performs data shifting on the stored data. After receiving digital image data of an entire scan line, the shift register 32 sends the digital image data to the latch circuit 33. The DAC 34 then receives digital voltage signals generated by the latch circuit 33 and converts the digital voltage signals into analog voltage signals. The output buffer 35 stabilizes the analog voltage signals and sends the stabilized analog voltage signals to the voltage/current converting circuit 36 for generating corresponding driving currents $I_r$, $I_g$, and $I_b$.

When the AMOLED panel 20 is operated normally, the thin film transistors TFT1 in the pixel circuits are turned on by the gate driver 24 via the scan lines $GL_1$-$GL_N$ based on the timing signals $V_{gate}$ generated by the control circuit 26. Then the driving currents $I_r$, $I_g$, $I_b$ corresponding to the data signal $V_{source}$ of images are sent to the storage capacitors Cs of the corresponding pixel circuits. With the voltage differences generated by charging the storage capacitors Cs, the thin film transistors TFT2 in the pixel circuits can be turned on for controlling the amount of current passing through the organic light emitting diodes OLED. Therefore, the pixel circuits can display images of different gray scales.

However, when displaying an image of a low gray scale smaller than a gray scale reference value, the driving current required for charging the storage capacitor Cs to create a desired voltage difference is also small, making it difficult to efficiently charge the storage capacitor Cs to the required voltage level. Under this circumstance, the pre-charge current source $I_{pre}$ is used for pre-charging the pixel circuits when displaying images of low gray scales in the AMOLED panel 20 of the present invention. If the AMOLED panel 20 determines that the pixel circuit $Pr_1$ needs to be pre-charged (how to determine whether a pixel circuit needs to be pre-charged will be described in more detail), the thin film transistor TFT1 of the pixel circuit $Pr_1$ is first turned on by the gate driver 24 and the switch $SW_r$ is turned on by the switch control signal $V_r$ generated by the gray scale circuit 30. Consequently, the pixel circuit $Pr_1$ is electrically connected to the pre-charge current source $I_{pre}$ for pre-charging the storage capacitor Cs of the pixel circuit $Pr_1$. Finally, the data line driving circuit 31 of the source driver 22 generates the driving current $I_r$ corresponding to the image to be displayed by the pixel circuit $Pr_1$, and then sends the driving current $I_r$ to the storage capacitor Cs of the pixel circuit $Pr_1$. Since the storage capacitor Cs of the pixel circuit $Pr_1$ has been pre-charged to a certain voltage level, it can easily be charged to the required voltage level in a frame period even with a small driving current $I_r$. Therefore, the AMOLED panel 20 of the present invention can improve display quality when displaying images of low gray scales.

Figure 4:
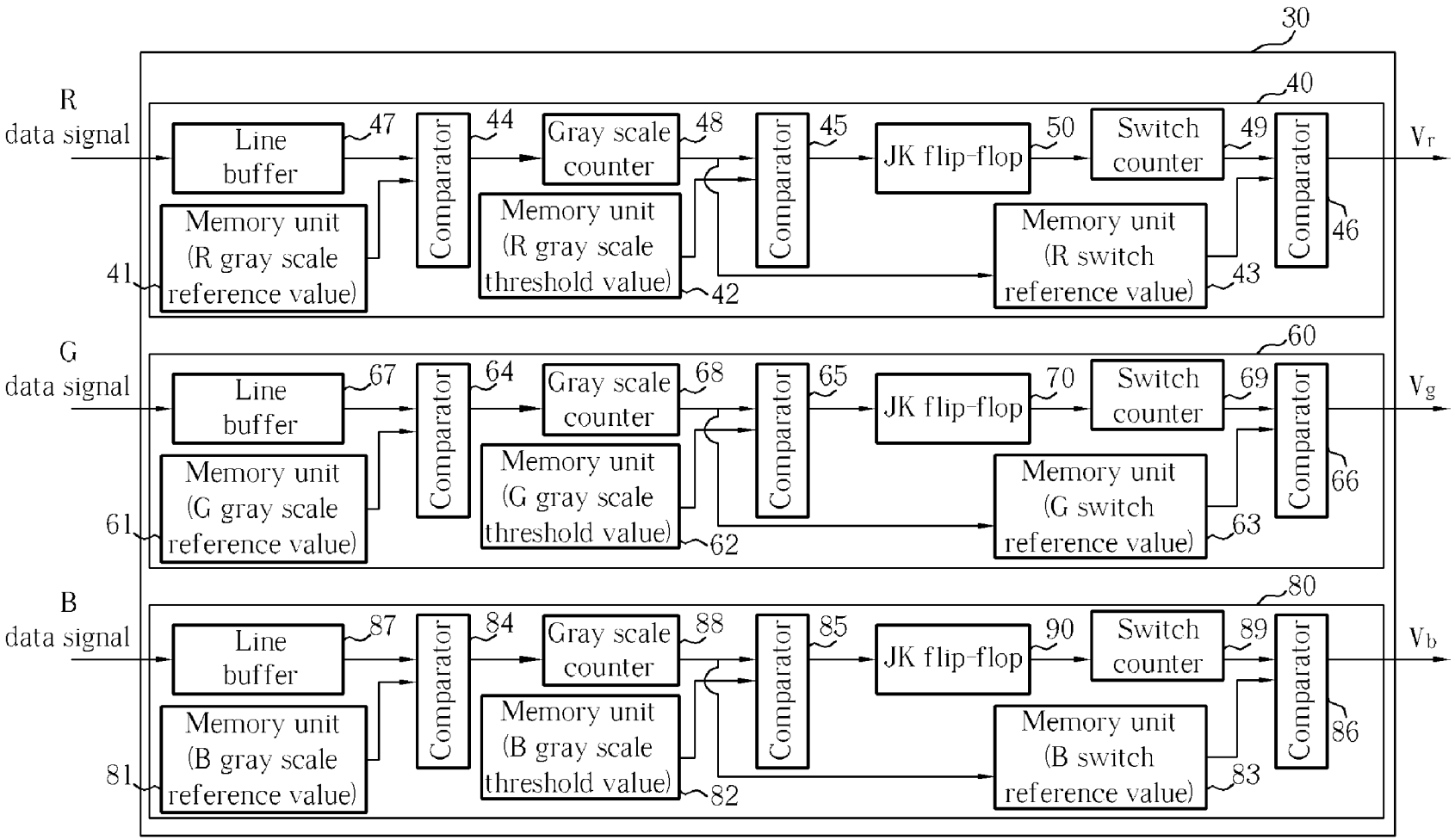
FIG. 4 is a diagram of a gray scale circuit of the AMOLED panel in FIG. 2.

FIG. 4 is a diagram of the gray scale circuit 30 of the present invention. FIG. 4 further illustrates how the AMOLED panel 20 performs steps of pre-charging. The gray scale circuit 30 includes judging circuits 40, 60 and 80 which determine whether the steps of pre-charging should be performed based on the data signal $V_{source}$, thereby generating the corresponding switch control signals $V_r$, $V_g$, and $V_b$. The judging circuit 40 includes memory units 41-43, comparators 44-46, a line buffer 47, a gray scale counter 48, a switch counter 49 and a JK flip-flop 50. The judging circuit 60 includes memory units 61-63, comparators 64-66, a line buffer 67, a gray scale counter 68, a switch counter 69 and a JK flip-flop 70. The judging circuit 80 includes memory units 81-83, comparators 84-86, a line buffer 87, a gray scale counter 88, a switch counter 89 and a JK flip-flop 90. An R gray scale reference value, a G gray scale reference value, and a B gray scale reference value are stored in the memory units 41, 61 and 81, respectively. An R gray scale threshold value, a G gray scale threshold value, and a B gray scale threshold value are stored in the memory units 42, 62 and 82, respectively. An R switch reference value, a G switch reference value, and a B switch reference value are stored in the memory units 43, 63 and 83, respectively. The gray scale reference values and the gray scale threshold values can vary according to different driving methods. If the gray scale of an image to be displayed by a pixel circuit is smaller than the gray scale reference value, the image is referred to as a low gray scale image. If the number of the pixel circuits of a scan line which display low gray scale images exceeds the gray scale threshold value, the scan line needs to be pre-charged.

The switch reference values correspond to the pre-charge time of the pixel circuits of the scan line.

Figure 5:
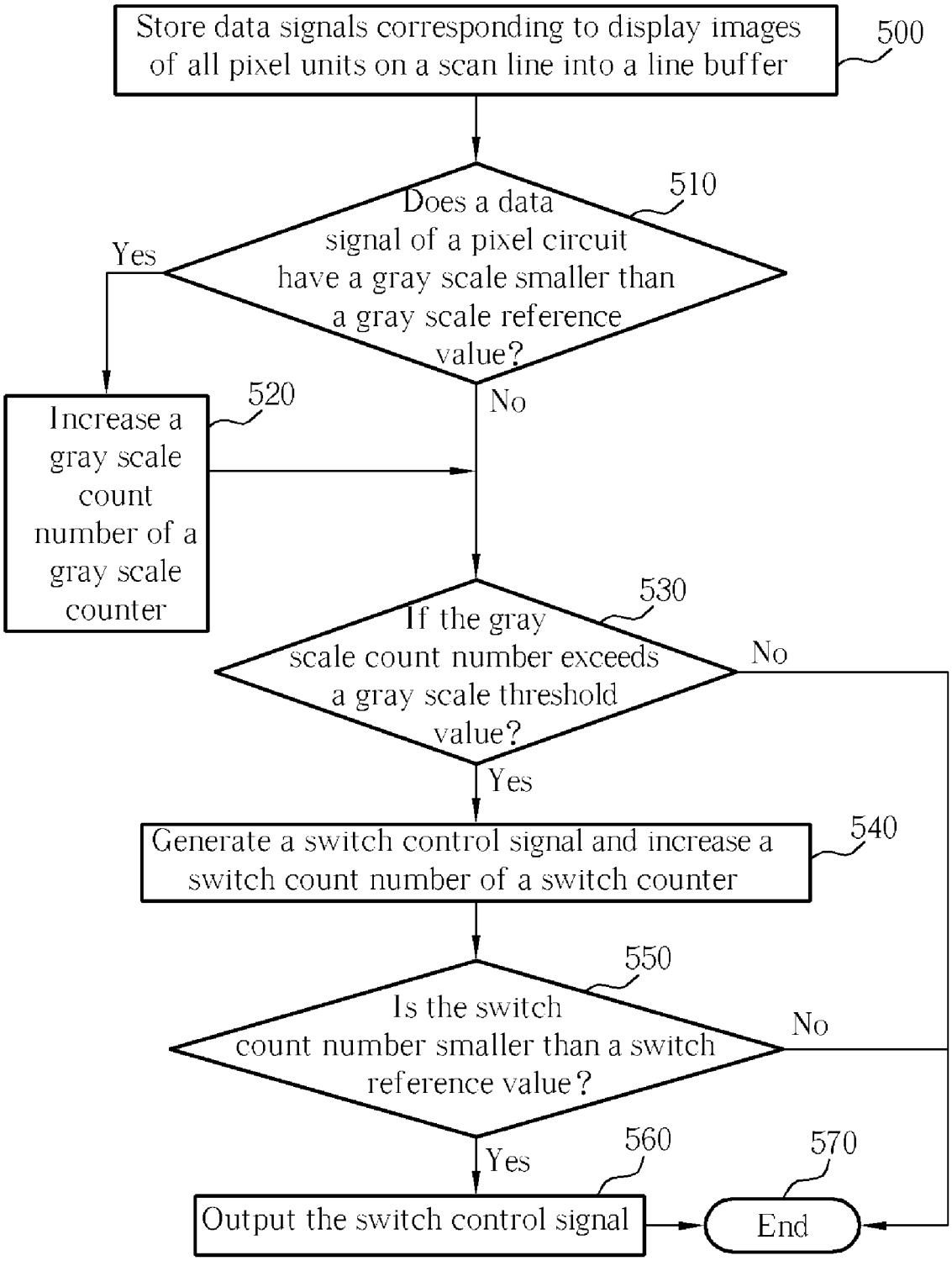
FIG. 5 is a flowchart illustrating the operations of the gray scale circuit in FIG. 4.

FIG. 5 is a flowchart illustrating the operations of the gray scale circuit 30. FIG. 5 includes the following steps:

Step 500: store data signals corresponding to display images of all pixel units on a scan line into a line buffer;

Step 510: determine if a data signal of a pixel circuit has a gray scale smaller than a gray scale reference value; if the pixel circuit has a gray scale smaller than the gray scale reference value, execute step 520; if the pixel circuit has a gray scale not smaller than the gray scale reference value, execute step 530;

Step 520: increase a gray scale count number of a gray scale counter;

Step 530: determine if the gray scale count number exceeds a gray scale threshold value; if the gray scale count number exceeds the gray scale threshold value, execute step 540; if the gray scale count number does not exceed the gray scale threshold value, execute step 570;

Step 540: generate a switch control signal and increase a switch count number of a switch counter;

Step 550: determine if the switch count number is smaller than a switch reference value; if the switch count number is smaller than the switch reference value, execute step 560; if the switch count number is not smaller than the switch reference value, execute step 570;

Step 560: output the switch control signal; and

Step 570: End.

The scan line $GL_1$ is used as an example for illustrating the present invention. In step 500, based on the data signals of the images to be displayed by the scan line $GL_1$, the control circuit 26 of the AMOLED panel 20 stores R data signals corresponding to red images into the line buffer 47, stores G data signals corresponding to green images into the line buffer 67, and stores B data signals corresponding to blue images into the line buffer 87. In step 510, the gray scale circuit 30 of the AMOLED panel 20 determines the relationship between the R data signals stored in the line buffer 47 and the R gray scale reference value stored in the memory unit 41, between the G data signals stored in the line buffer 67 and the G gray scale reference value stored in the memory unit 61, and between the B data signals stored in the line buffer 87 and the B gray scale reference value stored in the memory unit 81. For example, if the gray scale of an R data signal of the scan line $GL_1$ is smaller than the R gray scale reference value stored in the memory unit 41, the judging circuit 40 of the gray scale circuit 30 increase a gray scale count number of the gray scale counter 48 in step 520 before executing step 530; if the gray scale of an R data signal of the scan line $GL_1$ is not smaller than the R gray scale reference value stored in the memory unit 41, the judging circuit 40 of the gray scale circuit 30 executes step 530 directly. In step 530, the judging circuit 40 determines if the gray scale count number of the gray scale counter 48 exceeds the R gray scale threshold value stored in the memory unit 42. If the gray scale count number exceeds the R gray scale threshold value, which means the scan line $GL_1$ includes a sufficient amount of pixel circuits displaying low gray scale red images, the judging circuit 40 generates the switch control signal $V_r$ and increases the switch count number of the switch counter 49 in step 540. If the gray scale count number does not exceed the R gray scale threshold value, the judging circuit 40 executes step 570 directly. In step 550, if the switch count number of the switch counter 49 is smaller than the R switch reference value stored in the memory unit 43, the judging circuit 40 outputs the switch control signal $V_r$ for turning on the switch $SW_r$ of the source driver 22. The pre-charge current source $I_{pre}$ can then be electrically connected to the data line $DL_r$, thereby providing current for pre-charging the data line $DL_r$.

Similarly, the judging circuits 60 and 80 of the gray scale circuit 30 also perform the steps in FIG. 5 to the G data signals and the B data signals of the scan line $GL_1$, respectively. If the G data signals of the scan line $GL_1$ is smaller than the G gray scale reference value stored in the memory unit 61, if the gray scale count number of the gray scale counter 68 exceeds the G gray scale threshold value stored in the memory unit 62, and if the switch count number of the switch counter 69 is smaller than the G switch reference value stored in the memory unit 63, the judging circuit 60 outputs the switch control signal $V_g$ for turning on the switch $SW_g$ of the source driver 22 in step 560. The pre-charge current source $I_{pre}$ can then be electrically connected to the data line $DL_g$, thereby providing current for pre-charging the data line $DL_g$. If the B data signals of the scan line $GL_1$ is smaller than the B gray scale reference value stored in the memory unit 81, if the gray scale count number of the gray scale counter 88 exceeds the B gray scale threshold value stored in the memory unit 82, and if a switch count number of the switch counter 89 is smaller than the B switch reference value stored in the memory unit 83, the judging circuit 80 outputs the switch control signal $V_b$ for turning on the switch $SW_b$ of the source driver 22 in step 560. The pre-charge current source $I_{pre}$ can then be electrically connected to the data line $DL_b$, thereby providing current for pre-charging the data line $DL_b$.

Therefore, the present invention can improve the display quality when displaying images of low gray scales.

Figure 6:
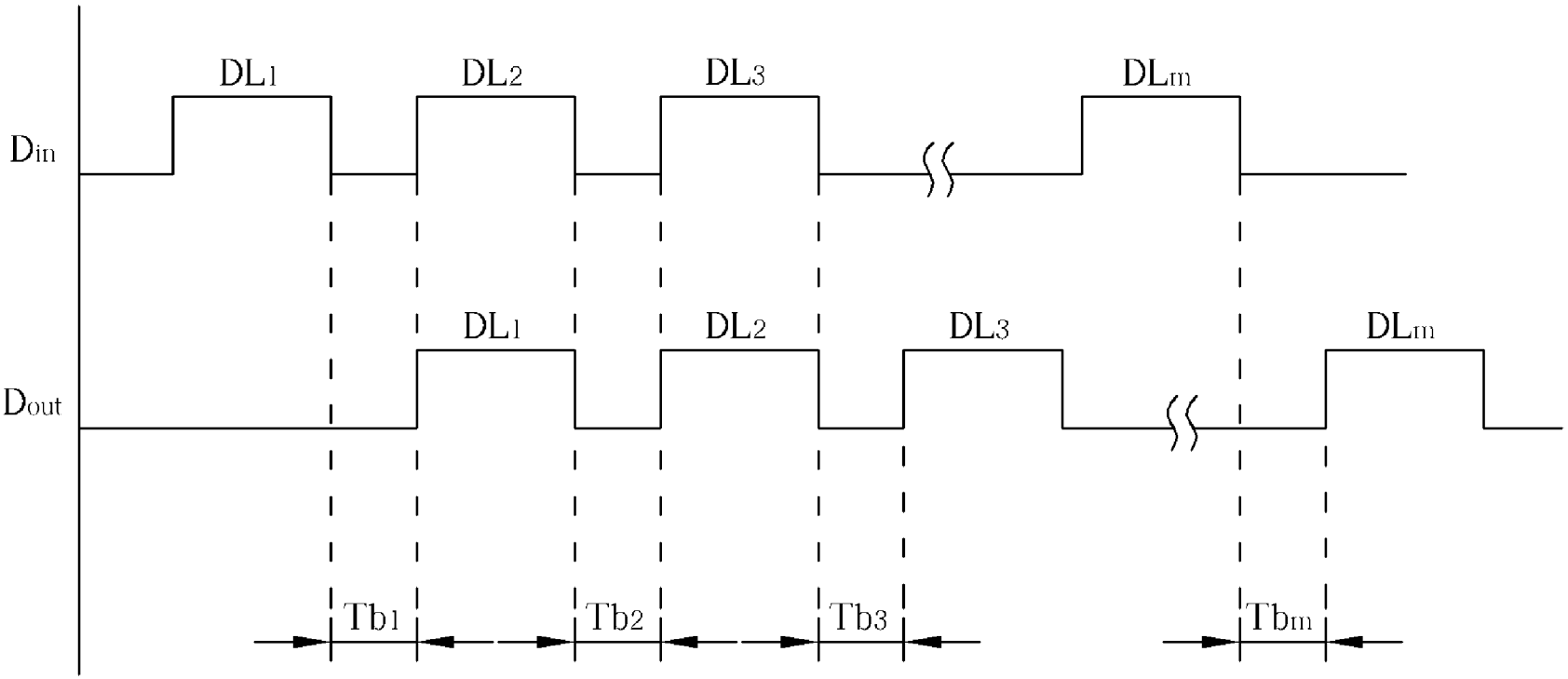
FIG. 6 is a timing diagram illustrating the operations of the AMOLED panel in FIG. 2.

FIG. 6 is a timing diagram illustrating the operations of the AMOLED panel 20. In FIG. 6, a waveform $D_{in}$ represents the input image signals inputted into a scan line, and $D_{out}$ represents the output image signals outputted by the scan line. When the waveform $D_{in}$ has a high voltage potential, image data is being inputted into the data lines $DL_1$-$DL_m$. When the waveform $D_{out}$ has a high voltage potential, image data is being outputted from the data lines $DL_1$-$DL_m$. In between inputting and outputting image data are blanking periods designated as $Tb_1$-$Tb_m$ in FIG. 6. The steps illustrated in FIG. 5 are performed in these blanking periods. Therefore, the present invention can improve display quality without influencing data input and output.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for driving an active matrix organic light emitting diode display comprising the following steps:

(a) determining whether a gray scale of an image to be displayed by a pixel circuit on a scan line is smaller than a gray scale reference value by counting the number of low gray scale pixel circuits wherein each of the gray scales of an image to be displayed by the low gray scale pixel circuits on the scan line is smaller than the gray scale reference value;

(b) transmitting a pre-charging current to the pixel circuit if the gray scale of the image to be displayed by the pixel circuit is smaller than the gray scale reference value; and (c) transmitting signals corresponding to the image to the pixel circuit after transmitting the pre-charging current to the pixel circuit.

2. The method of claim 1 further comprising:

determining whether the number of the low-gray-scale pixel circuits is larger than a threshold value.

3. The method of claim 2 wherein step (b) comprises transmitting a pre-charging current to the pixel circuit if the gray scale of the image to be displayed by the pixel circuit is smaller than the gray scale reference value and the number of the low-gray-scale pixel circuits is larger than the threshold value.

4. The method of claim 1 further comprising:

counting the number of times the scan line needs to be pre-charged.

5. The method of claim 1 wherein transmitting a pre-charging current to the pixel circuit is performed by coupling the pixel circuit to a current source of a source driver for transmitting the pre-charging current to the pixel circuit.

6. An active matrix organic light emitting diode display comprising:

a plurality of data lines for transmitting data signals;

a plurality of scan lines for transmitting scan signals;

a plurality of pixel circuits coupled to corresponding data lines and scan lines;

a source driver comprising:

a data line driving circuit for generating a driving current corresponding to an image to be displayed by a pixel circuit;

a current source for pre-charging a data line before sending the driving current to the data line; and a switch coupled between the current source and the data line for electrically connecting the current source to the data line, or for electrically isolating the current source from the data line;

a gate driver coupled to the plurality of scan line for generating control signals;

a timing controller for controlling the source driver and the gate driver based on video and timing data; and a gray scale circuit for controlling the switch of the source driver based on a gray scale of an image to be displayed by a pixel circuit of a scan line, the gray scale circuit comprising:

a gray scale counter for counting the number of low-gray-scale pixel circuits, wherein in a display frame images to be displayed by the low-gray-scale pixel circuits have gray scales smaller than a gray scale reference value;

a first memory unit for storing a threshold value; and a first comparator for comparing the number of low-gray-scale pixel circuits with the threshold value.

7. The display of claim 6 wherein the data line driving circuit comprises:

a shift register for generating digital voltage signals based on an image to be displayed by a pixel circuit;

a latch circuit for storing the digital voltage signals generated by the shift register;

a digital-to-analog converter (DAC) for receiving the digital voltage signals outputted from the latch circuit and for converting the digital voltage signals to analog voltage signals;

a buffer driver for enlarging the analog voltage signals and for outputting the enlarged analog voltage signals; and a voltage/current converting circuit for converting the received analog voltage signals into analog current signals.

8. The display of claim 6 wherein the gray scale circuit further comprises:

a line buffer for storing an image data to be outputted to a pixel circuit of the scan line;

a second memory unit for storing a gray scale reference value; and a second comparator for comparing a gray scale of the image data with the gray scale reference value.

9. The display of claim 6 wherein the gray scale circuit further comprises:

a switch counter for counting the number of times the switch of the source driver needs to be turned on;

a third memory unit for storing a switch reference value; and a third comparator for comparing the number of times the switch of the source driver needs to be turned on with the switch reference value.

10. The display of claim 6 wherein each of the plurality of pixel circuits comprises:

a first switch having a first end coupled to a corresponding scan line and a second end coupled to a corresponding data line;

a second switch having a first end coupled to a first power source and a second end coupled to a third end of the first switch;

a storage capacitor having a first end coupled to the third end of the first switch and a second end coupled to ground; and a light-emitting unit coupled between a third end of the second switch and a second power source for displaying images according to received current.

11. The display of claim 10 wherein the first and second switches include thin film transistors (TFTs).

12. The display of claim 10 wherein the light-emitting unit includes an organic light emitting diode (OLED).

13. The display of claim 10 wherein the first power source is a positive voltage source, and the second power source is a negative voltage source.

14. A method for driving an active matrix organic light emitting diode display comprising the following steps:

(a) counting the number of times a scan line needs to be pre-charged based on gray scales of images to be displayed by pixel circuits on the scan line;

(b) transmitting a pre-charging current to the pixel circuits based on the number of times the scan line needs to be pre-charged; and (c) transmitting signals corresponding to the images to the pixel circuits after transmitting the pre-charging current to the pixel circuits.

15. The method of claim 14 wherein transmitting the pre-charging current to the pixel circuits is performed by coupling the pixel circuits to a current source of a source driver for transmitting the pre-charging current to the pixel circuits.

16. An active matrix organic light emitting diode display comprising:

a plurality of data lines for transmitting data signals;

a plurality of scan lines for transmitting scan signals;

a plurality of pixel circuits coupled to corresponding data lines and scan lines;

a source driver comprising:

a data line driving circuit for generating a driving current corresponding to an image to be displayed by a pixel circuit;

a current source for pre-charging a data line before sending the driving current to the data line; and a switch coupled between the current source and the data line for electrically connecting the current source to the data line, or for electrically isolating the current source from the data line;

a gate driver coupled to the plurality of scan line for generating control signals;

a timing controller for controlling the source driver and the gate driver based on video and timing data; and a gray scale circuit for controlling the switch of the source driver based on a gray scale of an image to be displayed by a pixel circuit of a scan line, the gray scale circuit comprising:

a switch counter for counting the number of times the switch of the source driver needs to be turned on;

a memory unit for storing a switch reference value; and a comparator for comparing the number of times the switch of the source driver needs to be turned on with the switch reference value.

* * * * *